United States Patent [19]

Jumelle et al.

[11] Patent Number: 4,527,385

[45] Date of Patent: Jul. 9, 1985

[54] SEALING DEVICE FOR TURBINE BLADES OF A TURBOJET ENGINE

[75] Inventors: Louis F. Jumelle, Ris-Orangis; Marcel R. Soligny, Chevilly-Larue, both of France

[73] Assignee: Societe Nationale d'Etude et Je Construction de Moteurs d'Aviation "S.N.E.C.M.A.", France

[21] Appl. No.: 575,319

[22] Filed: Jan. 30, 1984

[30] Foreign Application Priority Data

Feb. 3, 1983 [FR] France ..... 83 01671

[51] Int. Cl.[3] ..... F01D 11/08; F02C 6/18

[52] U.S. Cl. ..... 60/39.07; 415/116; 415/138; 415/170 R; 60/39.75

[58] Field of Search ..... 415/110, 116, 134, 135, 415/136, 137, 138, 171, 174, 117, 180, 170 R; 60/39.75, 39.31, 39.32, 39.07

[56] References Cited

U.S. PATENT DOCUMENTS

| | | | |
|---|---|---|---|
| 3,807,891 | 4/1974 | McDow et al. | 415/116 |
| 3,966,354 | 6/1976 | Patterson | 415/116 |
| 4,019,320 | 4/1977 | Redinger, Jr. et al. | 60/39.75 |
| 4,127,357 | 11/1978 | Patterson | 415/116 |
| 4,363,599 | 12/1982 | Cline et al. | 415/171 |

FOREIGN PATENT DOCUMENTS

| | | | |
|---|---|---|---|
| 0079272 | 5/1983 | European Pat. Off. . | |
| 2450344 | 9/1980 | France . | |
| 2450345 | 9/1980 | France . | |
| 2467292 | 2/1983 | France . | |
| 1484288 | 9/1977 | United Kingdom | 415/116 |
| 2047354A | 11/1980 | United Kingdom . | |
| 2060077A | 4/1981 | United Kingdom . | |

*Primary Examiner*—Robert E. Garrett
*Assistant Examiner*—H. Edward Li
*Attorney, Agent, or Firm*—Bacon & Thomas

[57] ABSTRACT

A sealing device is disclosed for maintaining a small positive clearance between the sealing sectors and the turbine blade tips of a turbojet engine. The sealing segments are connected to an internal ring structure and an external ring structure located within the casing of the jet engine. The two ring structures serve to expand and contract the diameter of the ring formed by the sealing segments in conjunction with the expansion and contraction of the turbine blades for stabilized and transient engine operating modes. The device utilizes ventilating air taken from a stage of the jet engine compressor to cause the radial expansion or contraction of the internal and external rings in direct conjunction with the conditions under which the engine is operating.

27 Claims, 7 Drawing Figures

SEALING DEVICE FOR TURBINE BLADES OF A TURBOJET ENGINE

BACKGROUND OF THE INVENTION

1. Field of the Invention

The instant invention relates to a sealing device for the turbine blades of a turbojet engine, specifically such sealing devices which are adjustable to maintain a specific clearance between the sealing structure and the turbine blade tips during all operating modes of the tubrojet operation.

2. Brief Description of the Prior Art

It is important to minimize the clearance between the turbine blade tips and a sealing device in a turbojet engine in order to maximize the efficiency, to maximize the thrust, and to obtain a satisfactory surge margin of the turbojet engine due to leaks in the clearance between the rotating and stationary parts of the engine.

In order to reduce the leakage between the turbine blade tips and the surrounding structure, it is necessary to reduce the clearance between the blade tips and the sealing device to a minimum dimension and to maintain this dimension in both stable and transitory engine operating modes. The sealing device must remain concentric with the axis of rotation of the turbojet engine, and must expand and contract in a radial direction to compensate for the expansion and contraction of the turbine blades. The blades will undergo expansion during engine acceleration due to the increase in centrifugal forces and due to the increases in operating temperatures. Conversely, the turbine blades will contract during periods of engine deceleration or stabilized low power operating modes.

It has been extremely difficult to design a sealing system that surrounds the turbine blade tips and maintains a predetermined, minimum clearance during all stages of the turbojet engine operations. In addition to compensating for the expansion and contraction of the turbine blade tips, the sealing device must also take into consideration the potential action of inertia forces acting on the aircraft engines (load factors in the Z or Y direction) and deformations due to changing thermal characteristics. Additionally, the sealing device must retain its circular shape and cannot assume any degree of ovalness without incurring the risk of contact between the sealing device and the blade tips. Such contact would, at best, cause increases in the leakage between the blade tips and the sealing device and could possibly cause severe damage to the turbine blade structure.

The prior art devices have attempted to achieve these objectives by constructing a very rigid and heavy, or a very complex sealing system. Both systems have obvious drawbacks in regard to their use on aircraft engines: the first serving to increase the weight of the aircraft; while the second decreases the reliability of the turbojet engine.

The prior art also includes systems utilizing an abradable sealing surface which is worn away by the action of the turbine blades to minimize the clearance between them. However, these systems have not alleviated the leakage problems since, during expansion of the turbine blade tips, they abrade away the sealing surface and, when the operating conditions such that the turbine blades contract, a large clearance between the blade tips and the sealing device is present. An obvious way of avoiding this problem is to design the sealing device to accommodate the maximum diameter of the turbine blades. However, this introduces excessive leakage during those periods of operation when the turbine blades are not at their maximum diameter.

Although it is known, as described in French application No. 81.20719, filed Nov. 5, 1981, to center the casing supporting the sealing device with respect to the axis of the turbojet engine and provide it with sufficient inertia so that its deformation is essentially negligible, such devices cannot maintain a positive, but very small clearance between the sealing device and the turbine blade tips during both transitory and stabilized operating modes of the turbojet engine.

The prior art has also attempted to adjust the diameter of the sealing device in order to accommodate the expansion and contraction of the turbine blade tips by directing air taken from one or more stages of the turbojet engine compressor onto the sealing device to thereby cause its thermal expansion or contraction in a radial direction. The air is first directed into a distributor which, in turn, distributes the air in a homogeneous manner about the periphery of the sealing device. However, the quantity of air that is necessary to achieve the expansion or contraction of the sealing device in order to accommodate for both the centrifugal expansion of the turbine wheel and turbine blades (which occurs in a few seconds) and the subsequent thermal expansion of the turbine wheel (which takes place over several minutes) is usually excessive and results in the decreased efficiency of the turbojet engine compressor. A typical showing of such a system appears in French Pat. No. 2,467,292.

Although such air distributors can obviously be designed, as the prior art has indicated, they are extremely complex and, consequently, rather unreliable. Needless to say, a failure of such distributor would result in severe damage to the turbine blade or the sealing device.

As typlified in French Pat. Nos. 2,450,344 and 2,450,345, it is known to attempt to solve the problems noted above by making an inner part of the sealing device expand or contract to accommodate for the rapid centrifugal expansion of the turbine wheel and the turbine blade during acceleration and a second part which accommodates for the thermal expansion of the turbine wheel. However, such devices have been applied only to relatively low power turbojet engines having reverse flow combustion chambers. Although, in theory, such a system could be applied to the usual direct flow chambers of high power turbojet engines, they would be unduly complicated and inherently unreliable.

It is also known to utilize an elastic sleeve disposed about the turbine blades which is capable of deformation when exposed to stress. However, the elasticity of the sleeve presents the risk of introducing damage due to the lack of concentricity with the turbine wheel rotational axis, and due to the oval shape under the effect of load factors encountered in flight. It should be further noted that with the considerable hyperstatic forces generated by the supports in a segmented annulus, such as that shown in French Pat. No. 2,450,345, the slightest heterogeneity in temperature or inertia of the annular structure in the peripheral direction, will cause substantial deformations of the segmented ring. Such deformations will cause either lack of concentricity or result in the ovalization of the sealing structure, two factors, the maintenance of which are absolutely necessary to prevent excessive clearances between the turbine blade and sealing device.

SUMMARY OF THE INVENTION

The instant invention relates to a sealing device which provides a positive, minimum clearance between the sealing device and the turbine blade tips throughout all stabilized or transitory engine operating modes. The invention achieves these results by utilizing an appreciably reduced flow of air taken from the compressor of the turbojet engine so as to not reduce its efficiency, while at the same time achieving the results without undue complexity and the inherent lack of reliability as typified by the prior art devices.

The sealing device according to the present invention comprises a plurality of sealing segments attached to an internal ring structure. The sealing segments are also attached to an external ring which is disposed radially outwardly of the internal ring structure and the turbine wheel blade tips. Both ring structures are attached to an outer housing of the turbojet engine, the external ring being attached thereto by way of interengaging splines to permit expansion and contraction in the radial direction with respect to the outer casing.

The outer casing defines, with the inner ring structure a plenum chamber into which air is directed from one or more stages of the turbojet engine compressor. Means are provided to distribute this air over both the internal ring structure and the external ring. The air may be directed through a plurality of holes defined by the internal ring structure and the outer casing, and the sealing segment supports as well as the external ring may be provided with radial fins to facilitate heat transfer.

The internal ring structure may also comprise upstream and downstream portions mechanically fastened together via fastening means inserted through radially extending flanges. The upstream portion defines a plurality of cantilevered control fingers extending therefrom in a downstream direction, while the downstream portion defines a plurality of such fingers extending in an upstream direction. The cantilevered control fingers are located about the circumference of the upstream and downstream portions and are attached to the sealing segments at their distal ends. The construction of the cantilevered fingers and the internal ring structure is such that the fingers may resiliently deform with respect to the remaining structure.

In an alternative embodiment, a pressure regulating means may be provided in the air supply conduit upstream of the plenum chamber to control the pressure of the air within the plenum chamber.

In both embodiments, the air directed into the plenum chamber, and onto the internal ring structure and the external ring, during an acceleration phase of the engine causes the internal ring structure to expand initially to move the sealing segments radially outwardly. This initial expansion compensates for the centrifugal expansion of the turbine wheel and turbine blades caused by the increase in engine operating RPM. The expansion of the external ring requires a somewhat longer time to take place, due to its somewhat lower coefficient of thermal expansion. Thus, as the external ring increases in temperature, it expands radially outwardly and thereby moves the sealing segments an additional distance in the outward direction. The resiliency of the cantilevered control fingers of the internal ring structure allows this additional movement to take place without inducing severe stresses in the internal ring structure. This additional movement compensates for the thermal expansion of the turbine wheel and blades. A similar phenomenon occurs during deceleration such that the internal ring contracts initially to move the sealing segments radially inwardly, while the external ring contracts at a slower rate to move the sealing segments an additional distance.

The external ring may be provided with coatings of insulating material either on its radially outward, or radially inward surfaces, or both, to accurately control its thermal expansion characteristics to match those of the turbine wheel and turbine blades.

Thus, it is seen that the instant invention moves the sealing segments radially inwardly or outwardly to match the increase or decrease in radial dimensions of the turbine blade tips during both the stabilized or transitory engine operational modes.

DETAILED DESCRIPTION OF THE PREFERRED EMBODIMENTS

Figure 1:
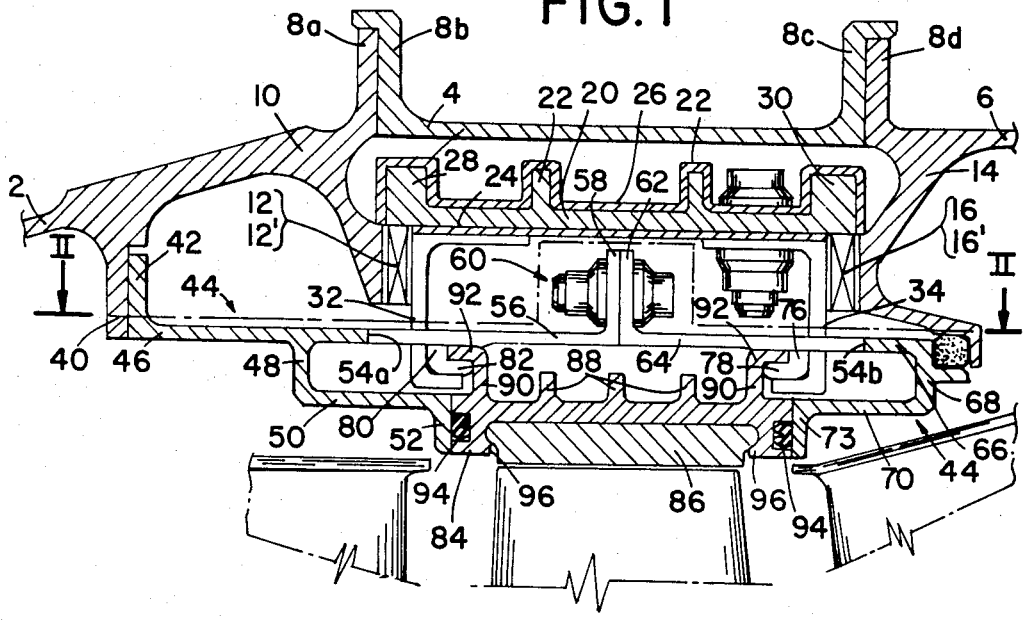
FIG. 1 is a partial, longitudinal sectional view showing the structural elements of a sealing device according to the invention.
Figure 3:
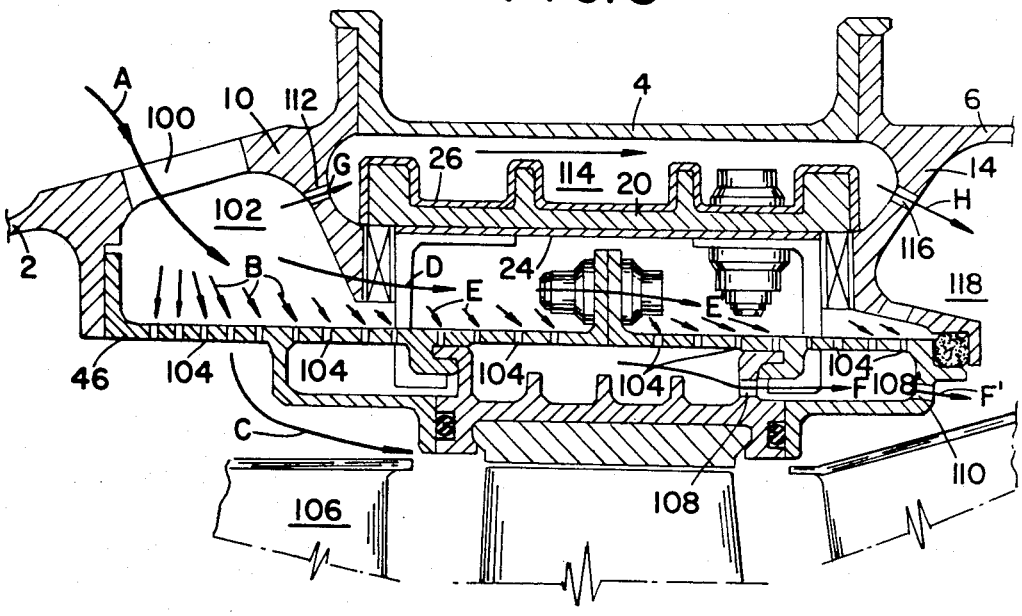
FIG. 3 is a partial longitudinal sectional view similar to FIG. 1, showing the air distribution holes and air flow pattern in the sealing device according to the invention.
Figure 2:
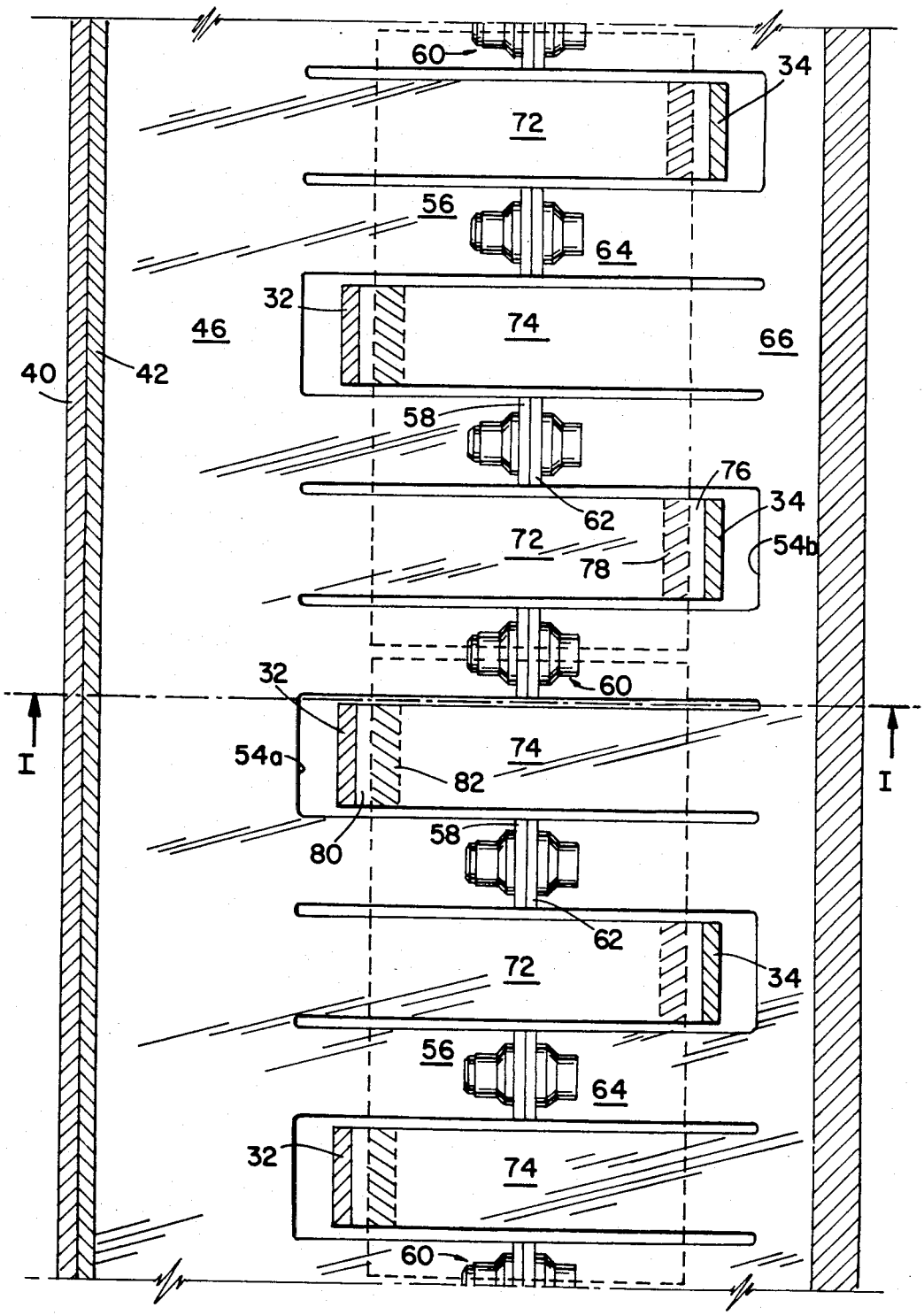
FIG. 2 is a partial view taken along lines II—II in FIG. 1, with the air distribution holes omitted for purposes of clarity.

FIGS. 1, 2 and 3 relate to a first embodiment of the invention. In FIG. 1, the ventilation holes through the outer casing structure and the internal ring structure have been omitted for the purposes of clarity. The ventilating openings as well as the direction of air flow across the sealing device according to this embodiment of the invention are shown in FIG. 3.

An outer casing of the turbojet engine comprises upstream part 2, a median part 4, and a downstream part 6, the three parts being interconnected via fastening means (not shown) extending through the radial flanges 8*a*–8*b*; and 8*c*–8*d*. The radial flanges also serve to provide mechanical inertia and rigidity to the assembly. Upstream part 2 has internal conical extension 10 in which radial splines 12 are machined. Similarly, downstream part 6 has an internal conical extension 14 into which radial splines 16 are machined such that they face radial splines 12.

External ring 20, formed of a material having a relatively high thermal inertia, has radial ribs 22 on its external surface and may be equipped with internal layer 24 and/or external layer 26 of thermal insulating material to adjust its thermal response time, as hereinafter described in more detail. External ring 20 also has upstream rib 28 and downstream rib 30 into which radial splines 12' and 16' are machined. These radial splines interengage with radial splines 12 and 16 to locate the external ring 20 within the engine casing. The interengagement of the splines 12 and 12', and 16 and 16' prevent relative circumferential movement between the external ring 20 and the engine casing, but allow relative radial movement between these elements. "L" shaped hook members 32 and 34 are attached to the upstream and downstream portions of external ring 20, respectively, and extend radially inwardly as shown. The base of hook member 32 extends in a downstream direction, while the base of hook member 34 extends in an upstream direction. These hook shaped members serve to attach the sealing segments to the external ring, as will be explained in more detail hereinafter.

Upstream part 2 of the outer casing further comprises a radial flange 40 extending inwardly toward the rotational axis. Radial flange 42 attached to cylindrical part 46 of the internal ring structure 44 is fastened to radial flange 40 by known fastening means (not shown). The internal ring structure 44 may comprise an upstream portion and a downstream portion, with means to fasten the portions together. The upstream portion may comprise radial flange 42 attached to cylindrical section 46 which extends generally parallel to the longitudinal or rotational axis of the engine and terminates in radial flange 58 at its downstream edge. A second cylindrical section 50 concentric with cylindrical section 46 is disposed radially inwardly of cylindrical section 46 and is connected therewith by radial flange 48.

The downstream portion of the internal ring structure 44 comprises flange 62 attached to third cylindrical section 66 which extends generally coaxially with cylindrical section 46, and fourth cylindrical section 70 located radially inwardly of cylindrical section 64, and concentric therewith. Radial flange 68 is connected to the downstream edges of cylindrical section 70 and cylindrical section 66. Fastening means 60, which may be a bolt and nut or similar fastening elements, are inserted through aligned openings in flanges 58 and 62 so as to retain the upstream and downstream portions in assembled relationship.

As best seen in FIG. 2, upstream cylindrical section 46 has a plurality of cantilevered control fingers 72 extending therefrom in a downstream direction. Similarly, the downstream cylindrical section 66 has cantilevered control fingers 74 extending therefrom in an upstream direction. Cylindrical sections 46 and 66 define slots **54*a* and 54*b*, respectively, to accommodate the cantilevered control fingers extending from the opposite cylindrical section. As can be seen, slots 54*a* accommodate the cantilevered control fingers 74 extending from cylindrical section 66, while slots 54*b* accommodate control fingers 72 extending from cylindrical section 46**.

The material from which the internal ring structure is fabricated is sufficiently resilient to allow the cantilevered control fingers 72 and 74 to resiliently deform with respect to the remaining structure.

"L" shaped hook members 76 are attached to the distal ends of cantilevered control fingers 72 and engage inverted "L" shaped hook members 90 attached adjacent to the downstream edges of sealing segments 84. Similarly, "L" shaped hook members 80 are attached to the distal ends of cantilevered control fingers 74 and engage inverted "L" shaped hook members 90 attached adjacent to the upstream edge of the sealing segments 84.

Base portion 78 of hook member 76 is engaged by a base portion of hook member 34 attached to external ring 20. The base portion 82 of hook member 80 is also engaged by the base portion of hook member 32 attached to external ring 20. Thus, as can be seen, sealing segments 84 having sealing surface 86 which forms an annular seal about the tips of the turbine blades, are connected to both the internal ring structure and the external ring via interengagement of the respective hook members. Sealing segments 84 may have radial stiffener flanges 88 to give them added rigidity. The sealing segments are longitudinally located between depending flange 52 associated with cylindrical section 50 at the upstream side and depending flange 73 attached to cylindrical section 70 on the downstream side. Seals 94 may be interposed between the sealing sectors and the respective upstream and downstream flanges to insure against leakage between these elements. Sealing element 86 is retained in sealing segment 84 by retaining beads 96 extending along the upstream and downstream edges.

FIG. 3 shows the air distribution pattern of the structure just described. A plurality of holes 100 are formed in the upstream part 2 of the outer casing and are distributed in regular fashion about its circumference. Ventilating air taken from a stage of the turbojet engine compressor and directed to the holes 100 by known conduit means passes through opening 100 and into plenum chamber 102 in the direction of arrow A. Plenum chamber 102 forms a tranquilizing chamber for the incoming air. The air passes through a plurality of holes 104 formed in the upstream and downstream sections of internal ring structure 44 according to arrows B, E and E'. It should be understood, that holes 104 are formed in a regular pattern throughout upstream and downstream portions of internal ring structure 44, but that they have been omitted from FIG. 2 for the purposes of clarity. A portion of the air passes through the holes 104 and traverses along the path designated by arrow C where it is conducted downstream to vane 106 of the turbine. A portion of the air from plenum chamber 102 also passes along the path designated by arrow D around hook shaped elements 32 and through holes 104 along the path designated by arrows E. In similar fashion, the downstream portion of the internal ring structure is ventilated by the air passing along arrow E' and through holes 104. The ventilating air passing along these sections and through the holes 104 serves to effect a rapid heat transfer between it and the internal ring structure.

The portion of the ventilating air passing through the internal ring structure above the sealing segments passes through a plurality of openings 108 formed in inverted hook members 90 and passes into chamber 108' along arrow F. Chamber 108' is ventilated via holes 110 formed through radial flange 68 to allow the air to pass therethrough along arrow F' into chamber 118.

Another portion of the air from plenum chamber 102 passes through holes 112 formed in flange 10 along arrows G into chamber 114 between the external ring 20 and the median part 4 of the engine casing. This air then passes through holes 116 formed in flange 14 along arrow H and into chamber 118 where it is mixed with the ventilating air passing through openings 110 along arrow F'.

The air distribution pattern just described provides a homogeneous temperature distribution both peripherally and longitudinally on both the internal ring structure and the external ring. Thus, if it is assumed that the engine is operating in an idling or cruising mode, an increase in the throttle setting will increase the RPM's of the turbine wheel and, at the same time, increase the temperature of the ventilating air due to the pressure increase in the compressor. The higher temperature ventilating air will initially cause the internal ring structure to expand radially outwardly, since this has a higher coefficient of thermal expansion than the external ring 20 and does not have the insulating layers 24 and 26. The expansion of the internal ring structure will move the sealing segments 84 in a radially outward direction to compensate for the centrifugal expansion of the turbine blades and wheel due to the increased RPM of the engine. As the turbine blades continue to expand due to thermal expansion caused by the increased operating temperatures, the external ring will expand radially outwardly due to its contact with the ventilating air passing through chamber 114. This expansion will move the sealing segments 84 further radially outwardly and cause resilient deflection of the cantilevered control fingers 72 and 74. This will continue until a stabilized operating mode is achieved. Thus, as can be seen, the device according to the invention provides a minimum clearance between the sealing element 86 and the turbine blades in both the transitory and stabilized operating modes.

A similar chain of events will occur when the engine speed is reduced. The device will maintain the minimum clearance during the contraction of the turbine blades and wheel due to decreased centrifugal forces and thermal contraction due to lowered operating temperatures.

The internal ring structure is fabricated from a metal having both a relatively high coefficient of expansion and an elastic range up to temperatures on the order of 450° to 500° C. The metal may be of the type designated Z 50 NMC 12 (AFNOR standard).

In order to prevent binding of the hooked shaped members, the edges of hook members 32 and 34 as well as the edges of base portions 78 and 82 may be slightly rounded. The edges of hook elements 92 may also be rounded where they engage hook members 76 and 80 to avoid any possibility of jamming or binding during operation.

The extremities of sealing segments 84 are shown by dashed lines in FIG. 2. As can be seen, each sealing segment 84 is supported on three cantilevered control fingers. The lower segment, as shown in FIG. 2, is supported on the upstream edge by two control fingers 74 extending from downstream cylindrical section 66, while the downstream edge of this segment is supported by control finger 72 extending from upstream portion 46. In the adjacent sealing segment, the order of support is reversed, the upstream edge is supported by a single control finger 74, while the downstream edge is supported by two control fingers 72.

It should also be noted that hooks 32 (34, respectively) and 82 (78, respectively) may be slightly offset in a circumferential direction. This makes it possible to support trapezoidal sealing segment on the four adjacent supports of four corners of a trapezoid.

FIGS. 4–7 disclose an alternative embodiment of the instant invention. As can be seen from FIGS. 4 and 6, the seals 94 between the sealing segments 84 and the dependent flanges 52 and 73 have been eliminated in this embodiment and spaces j and j' exist between the aforementioned flanges and the sealing segments. Preferably, the upstream clearance j is slightly larger than the downstream clearance j' (for example: 0.3 upstream and 0.1 downstream).

There is also a tap of the static pressure on wall 120 in the downstream part of the vane 106 upstream of the turbine wheel and conduit 122 connects this tap to a port of pressure regulator 124. Pressure regulator 124 is also connected to the engine compressor via conduit 126, and to plenum chamber 102 via conduit 128.

The downstream portion of the internal ring structure also differs from that disclosed in FIGS. 1–3 insofar as it includes a plurality of longitudinally extending heat exchange fins 130 distributed about cylindrical portion 66. Fins 130 may extend radially outwardly and radially inwardly as shown to achieve the requisite heat transfer between the ventilating air and the downstream portion and eliminate the necessity for holes 104 in cylindrical section 66.

Figure 4:
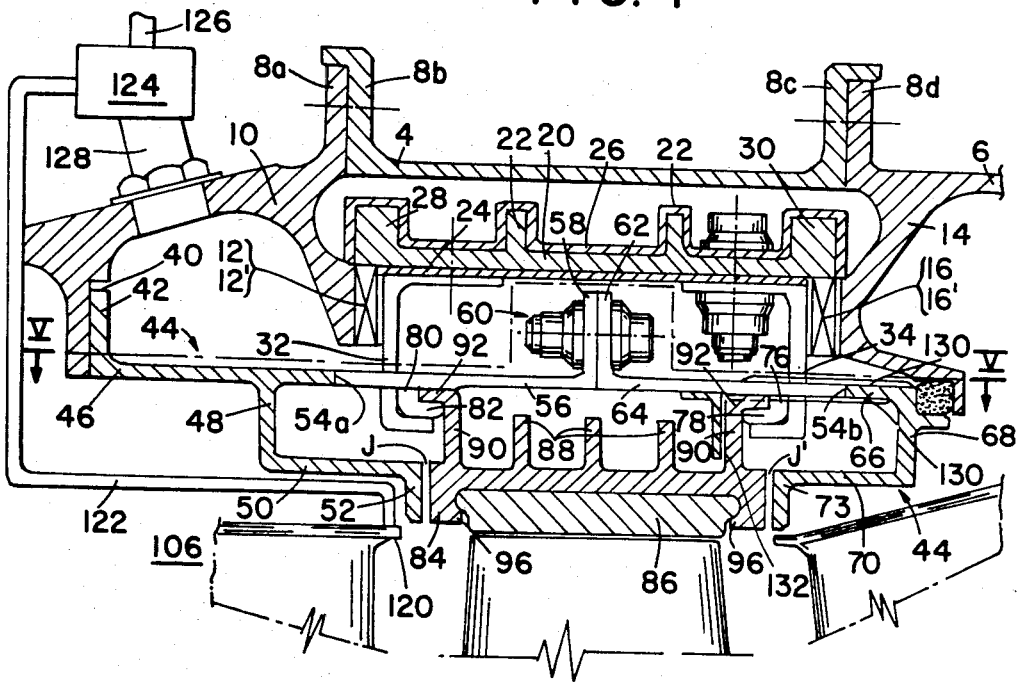
FIG. 4 is a partial, longitudinal sectional view showing the structural elements of a second embodiment of the invention.
Figure 6:
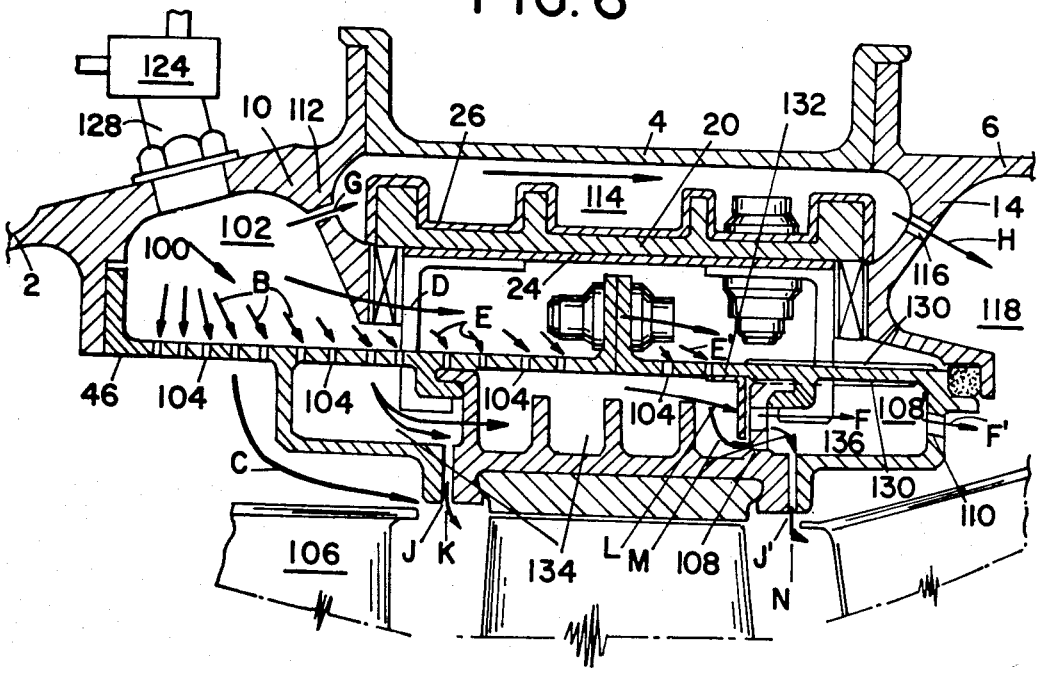
FIG. 6 is a partial, longitudinal sectional view similar to FIG. 4 showing the air distribution holes and air flow pattern according to the second embodiment of the invention; and, FIG. 7 is a longitudinal sectional view of the pressure regulator utilized with the embodiment shown in FIGS. 4–6.
Figure 5:
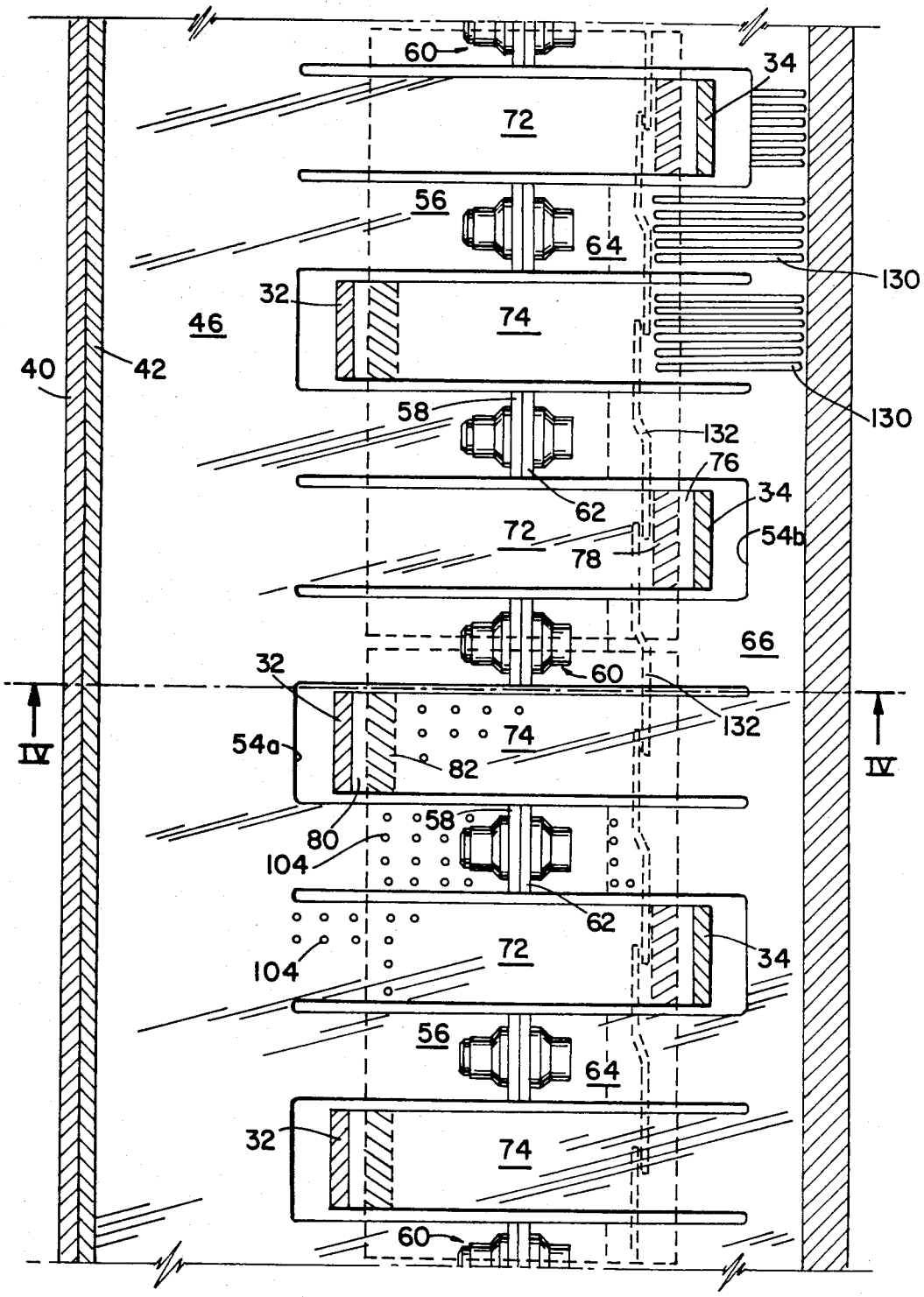
FIG. 5 is a partial sectional view taken along lines V—V of FIG. 4.

The cylindrical section 66 of the downstream portion also has a plurality of right angle elements 132 attached to its inner periphery and extending radially inwardly as shown in FIGS. 4 and 6. Adjacent right angle elements 132 overlap as shown in FIG. 5 with a slight clearance between them so as to create a pressure drop between the upstream chamber 134 and downstream chamber 136. Right angle elements 132 are disposed adjacent to inverted hook members 90, but with a slight clearance therebetween. The height of the angle elements should also be sufficient to permit clearance between the sealing segments 84 and their inner extremities during all phases of the operation of the device.

Also in this embodiment, holes 110 through flange 68 are enlarged and/or increased in number with respect to holes 116 through flange 14. This is necessary in order to equalize the pressures when the ventilating air flows along the directions of arrows F' and H are combined due to the pressure drop in chamber 136.

With this arrangement, when the engine is operating under full throttle stabilized condition, the radial clearance between sealing segments 84 and the internal edge of the angle elements 132 is smaller than under the conditions of a partial throttle stabilized operation. This increases the pressure differential between the enclosures 134 and 136 when the engine is under a strong load. This corresponds to the direction of the variation of pressure within the jet engine, as the pressure drop across the turbine wheel increases with a rising load on the engine. This favorable effect is partially compensated by the leakage flow which may exist between the angle elements 132 and the cantilevered control fingers 72 and 74 when the latter are displaced radially outwardly due to the expansion of the external ring 20.

The air flow over the sealing device according to this embodiment of the invention is shown in FIG. 6. The ventilating air passes from a downstream stage of the compressor, through the pressure regulator into plenum chamber 102, and through holes 104 in cylindrical part 46. A portion of this air passes into chamber 134 through holes 104 and across the sealing segments. A portion of this flow also passes downwardly through radial space j, as indicated by arrow K. As explained in more detail below, the pressure regulator 124 regulates the pressure in chamber 134 in conjunction with the static pressure on the wall measured by the pressure tap 120. The flow along the direction of arrow K through the clearance j is reduced to a minimum due to the rather small pressure differential.

The portion of the flow from chamber 134 passing over the sealing segments 84 passes around the right angle elements 132 either through the slight clearance between the overlapping portion of the angles (along arrow L) or through the clearance between the angles 132 and the sealing segments (arrow M). In some cases the ventilating air may pass through the clearance between the angle elements 132 and the cantilevered control fingers 72 and 74. Because of the circuituous path and the relatively small size of the clearances, the ventilating air arriving in the chamber 136 is at a lower pressure than that in the chamber 134. A portion of this flow passes from chamber 136 through slot j', as indicated by the arrow N, while the remaining portion follows the circuit described in relation to the previous embodiment (along the paths indicated by arrows F and F').

Figure 7:
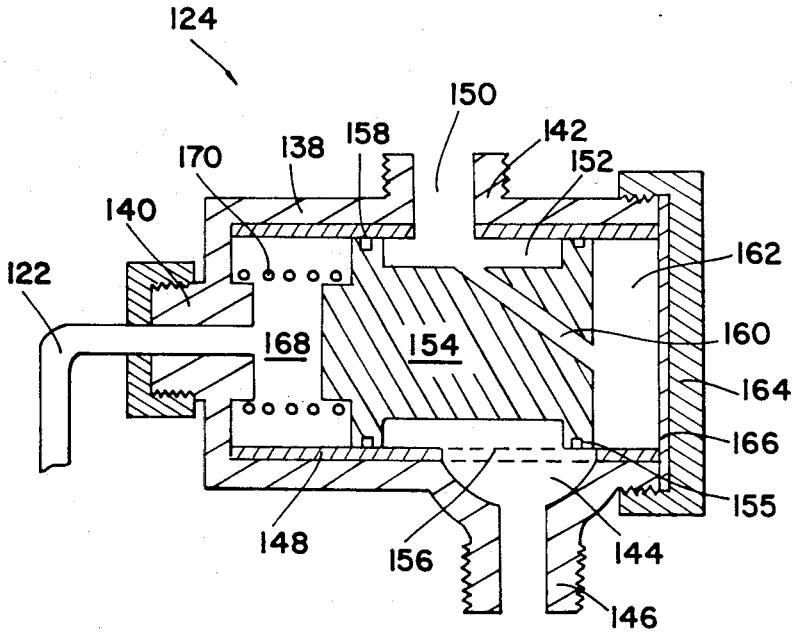

The pressure regulator 124 is shown in detail in FIG. 7 and comprises a housing 138 having a first port 150 defined by boss 142, a second port defined by boss 146 and a third port defined by boss 140. Conduit 122 connects the third port with the static pressure tap 120, while conduit 126 (see FIG. 4) connects ports 150 to a downstream stage of the engine compressor. Conduit 128 connects the second port with the plenum chamber 102.

Port 146 has a widened portion 144 which communicates with the interior of housing 138. A spool 154 is slidably retained within housing 138 and has seals 158 about the periphery of lands 155 to prevent leakage of fluid into end chambers 162 and 168. A cylindrical jacket 148 is mounted in the interior of housing 138, the jacket defining a first port in alignment with port 150 and a slot 156 which extends across widened portion 144 of port 146. Lands 155 with seals 158 bear against the interior surface of jacket 148 such that the spool may be slidably displaced therein. Spool 154 also defines obligue orifice 160 which permits communication between the inlet port 150 and end chamber 162. The pressure in end chamber 162 is, therefore, equal to the pressure of the ventilating air taken from the downstream stage of the compressor. This pressure is higher than the pressure prevailing in the chamber 168, which is equal to the static pressure of the wall 120 taken through line 122. In effect, the static pressure at tap 120 corresponds to the downstream pressure of the compressor reduced by the pressure drop in the chamber and the drop of static pressure in the vein upstream of the turbine wheel (actually corresponding to the pressure losses of one or several upstream turbine stages if the device is used for one of the BP wheels of the turbine). The force applied to the spool slide 154 urging it toward the left, as seen in FIG. 7, is balanced by compression spring 170.

The parameters of the pressure regulator, in particular the dimensions of the slot 156, the diameter and number of turns of the spring 170 and the pressure drop through the multiple holes 104 in the internal ring structure are determined according to given engine operating conditions, such as engine load, altitude, flight velocity, etc., such that the pressure prevailing in chamber 134 will be slightly higher than the static pressure measured at the tap 120. This calculation obviously depends upon the individual parameters of the turbojet engine and is well within the ability of the person skilled in the art.

If the operating conditions (engine load, altitude, flight velocity, etc.) change, for example causing an increase in the static pressure at tap 120, the pressure taken from the compressor itself is generally increased, which is favorable. It shall be assumed in the following discussion that this increase in pressure is insufficient to completely compensate (in view of the pressure drop in the multiple holes 104) the pressure rise measured at tap 120. Under these conditions, pressure regulator 124 may adjust the pressure in chamber 134 via the following steps: the rise in the pressure on the wall upstream from the turbine wheel is detected by the static pressure tap 120 and communicated (via conduit 122) to the left side of spool slide 154. Consequently, slide 154 is displaced toward the right, as seen in FIG. 7, thereby uncovering an additional section of the slot 156 through jacket 148. The pressure drop in this slot is reduced by increasing the area of the passage section and a consequent increase in pressure in the plenum chamber 102 occurs. This is reflected, after deducting a certain pressure drop as the air passes through holes 104 by an increase in pressure in chamber 134. By varying the shape of the slot 156, the pressure in chamber 134 will follow the pressure measured at tap 120, i.e., it will always remain higher, but only by a specified amount. Various configurations of slot shapes may be utilized for the slot 156 to ensure that the pressure in chamber 134 will follow as closely as possible the pressure measured at the tap 120. The criteria for selecting a specific slot shape is well within the ability of the person skilled in the art.

As indicated above, the pressure in chamber 136 is always less than that in 134 due to the pressure drop induced by the passage of air around angled elements 132. The pressure drop in the conduit is generally higher than the pressure drop between the chambers 134 and 136. For this reason, it is preferable to have a positive clearance j' in the downstream direction, but to have such clearance smaller than the upstream clearance j.

In order to increase the pressure drop between chamber 134 and chamber 136, holes 110 extending through flange 68 are either increased in number or in size with respect to holes 110 of the previous embodiment. Consequently, the holes 116, passing through internal flange 14 are reduced in number or size in order to equalize the pressures entering chamber 118 at a lower level. This serves to equalize the pressure of the air flowing in a direction of arrow H with that flowing along the path designated by arrow F'. This lowering of the pressure in chamber 118 also serves to minimize the flow passing through clearance j' along arrow N.

The scope of the instant invention also encompasses the use of two pressure regulators 124: one supplying the upstream chamber 134 through the plenum chamber 102; and the other supplying the downstream chamber 136 through a line similar to 128, but opening directly into the chamber. The latter pressure regulator would be controlled by means of a conduit similar to conduit 122 connected to a tap of the static wall pressure similar to that at 120. However, this tap would be mounted in front of the downstream vane 107 of the turbine.

It is also possible to use a single pressure regulator 124, but having two slots 156, with each of the slots being offset peripherally around the casing 138. A first slot would be connected via a port to chamber 134 through plenum chamber 102, while the second slot would be directly connected to chamber 136 via an additional conduit. The second slot should have an effective cross section smaller than that of the slot supplying the chamber 134 in order to effect the pressure differential between chamber 134 and 136.

The foregoing descriptions are provided for illustrative purposes only and should not be construed as in any way limiting the scope of this invention, which is defined solely by the appended claims.

What is claimed is:

1. In a turbojet engine having a compressor, an outer casing having a longitudinal axis, and at least one turbine wheel rotatably mounted within the casing, the turbine wheel having a plurality of turbine blades attached thereto, a device for effecting a seal between the turbine blades and the outer casing during stabilized and transitory operating modes of the engine, comprising:

(a) an annular external ring attached to the outer casing;

(b) an internal ring structure having a higher coefficient of thermal expansion than the external ring, attached to the outer casing, the internal ring also having a plurality of longitudinally extending, cantilevered control fingers disposed about its circumference, each control finger having a distal end;

(c) a plurality of sealing segments disposed radially outwardly of the tips of the turbine blades, each of the sealing segments having a sealing surface disposed in close proximity to the tips of the turbine blades;

(d) first attachment means attaching each of the sealing segments to the internal ring structure;

(e) second attachment means attaching each of the sealing segments to the external ring; and, (f) means to direct air from a stage of the compressor onto the external ring and the internal ring structure such that the thermal expansion/contraction of the internal ring structure and the external ring moves the sealing segments radially outwardly/inwardly corresponding to the expansion/contraction of the blade tips due to different operating modes of the engine in order to maintain clearance between the blade tips and the sealing segments, and to prevent excess air leakage between the blade tips and the sealing segments.

2. The sealing device according to claim 1 wherein the external ring further comprises at least one radially outwardly extending rib about its circumference.

3. The sealing device according to claim 2 further comprising: first spline means formed on upstream and downstream portions of the outer casing; and, second spline means formed on the external ring so as to engage the first spline means, such engagement permitting radial expansion and contraction of the external ring with respect to the outer casing.

4. The sealing device according to claim 3 further comprising a thermal insulating material attached to the radially outward surface of the external ring.

5. The sealing device according to claim 4 further comprising a second thermal insulating material attached to the radially inward surface of the external ring.

6. The sealing device according to claim 3 further comprising a thermal insulating material attached to the radially inward surface of the external ring.

7. The sealing device according to claim 1 wherein the internal ring structure comprises: (a) an upstream portion attached to the outer casing and having a first radial flange extending from a downstream edge thereof; (b) a downstream portion having a second radial flange extending from an upstream edge thereof; and, (c) fastening means to fasten the first and second flanges together so as to retain the upstream and downstream portions in assembled relationship.

8. The sealing device according to claim 7 wherein the upstream portion has a plurality of cantilevered control fingers attached thereto, the control fingers having distal ends extending in a downstream direction.

9. The sealing device according to claim 8 wherein the downstream portion defines a plurality of slots about its circumference, each slot located so as to accommodate a distal end of the cantilevered control fingers extending from the upstream portion.

10. The sealing device according to claim 9 wherein the downstream portion has a plurality of cantilevered control ringers attached thereto, the control fingers having their distal ends extending in an upstream direction.

11. The sealing device according to claim 10 wherein the upstream portion defines a plurality of slots about its circumference, each slot located so as to accommodate a distal end of the cantilevered control fingers extending from the downstream portion.

12. The sealing device according to claim 11 wherein the upstream portion defines a plurality of holes therethrough to facilitate passage of air from the engine compressor.

13. The sealing device according to claim 12 wherein the downstream portion defines a plurality of holes therethrough to facilitate passage of air from the engine compressor.

14. The sealing device according to claim 13 wherein the upstream portion comprises: (a) a first cylindrical section extending parallel to the longitudinal axis of the engine, the first cylindrical section having the first radial flange extending from its downstream edge; (b) means to attach the first cylindrical section to the outer casing; (c) a second cylindrical section concentric with and disposed inwardly of the first cylindrical section, the second cylindrical section having a depending flange extending from its downstream edge; and, (d) means to attach the second cylindrical section to the first cylindrical section.

15. The sealing device according to claim 14 wherein the downstream portion comprises: (a) a third cylindrical section coaxially aligned with the first cylindrical section, the third cylindrical section having the second radial flange extending from its upstream edge; (b) a fourth cylindrical section concentric with the third cylindrical section and generally coaxially aligned with the second cylindrical section, the fourth cylindrical section having a depending flange extending from its upstream edge; and, (c) a third radial flange interconnecting the downstream edges of the third and fourth cylindrical sections.

16. The sealing device according to claim 15 wherein the first attachment means comprises: (a) a plurality of first, inverted "L" shaped hook members attached to each of the sealing segments adjacent its upstream and downstream edges; (b) a plurality of second "L" shaped hook members attached to the distal ends of the control fingers attached to the downstream portion and engaging those first hook members attached adjacent to the upstream edge of the sealing segments; and, (c) a plurality of third "L" shaped hook members attached to the distal ends of the control fingers attached to the upstream portion and engaging those first hook members attached adjacent to the downstream edge of the sealing segments.

17. The sealing device according to claim 16 wherein the second attachment means comprises: (a) a plurality of fourth "L" shaped hook members attached to the external ring adjacent to its upstream edge and engaging those first hook members attached adjacent to the upstream edge of the sealing segments; and (b) a plurality of fixed "L" shaped hook members attached to the external ring adjacent to its downstream edge and engaging those first hook members attached adjacent to the downstream edge of the sealing segments.

18. The sealing device according to claim 17 wherein the first inverted "L" shaped hook members attached adjacent to the downstream edges of the sealing segments define a plurality of holes therethrough to facilitate the passage of air from the compressor.

19. The sealing device according to claim 17 further comprising seals interposed between the upstream edges of the sealing segment and the depending flange of the second cylindrical section and between the downstream edges of the sealing segments and the depending flange of the fourth cylindrical section.

20. The sealing device according to claim 17 further comprising a plurality of radially and longitudinally extending heat exchange fins formed about the circumference of the third cylindrical section.

21. The sealing device according to claim 20 wherein the third radial flange defines a plurality of holes therethrough to facilitate the passage of air from the compressor.

22. The sealing device according to claim 21 further comprising a plurality angle elements attached to the third cylindrical section such that they extend radially inwardly adjacent to the first inverted "L" shaped hook members attached adjacent to the downstream edges of the sealing segments.

23. The sealing device according to claim 1 wherein the outer casing and the inner ring structure define a plenum chamber and the means to direct air comprises conduit means connecting the plenum chamber to a stage of the compressor.

24. The sealing device according to claim 23 further comprising pressure regulator means connected to the conduit means to regulate the pressure in the plenum chamber.

25. The sealing device according to claim 24 wherein the pressure regulator means comprises:

(a) a housing having first, second and third ports;
(b) first conduit means connecting the first port to the compressor;
(c) second conduit means connecting the second port to the plenum chamber;
(d) third conduit means connecting the third port to a static pressure tap of the turbine; and,
(e) a spool slide slidably retained in the housing and having a first end exposed to the fluid pressure in the third conduit such that, as this pressure increases, the spool slide is displaced to uncover a larger amount of the second port so as to increase the pressure in the plenum chamber and vice versa.

26. The sealing device according to claim 25 wherein the spool slide defines an orifice allowing fluid communication between the first port and a second end of the spool slide.

27. The sealing device according to claim 26 further comprising a hollow cylindrical jacket removably inserted in the housing, the jacket having a first opening aligned with the first port and a second, slot shaped opening extending across the second port.

* * * * *

UNITED STATES PATENT AND TRADEMARK OFFICE

CERTIFICATE OF CORRECTION

PATENT NO. : 4,527,385

DATED : July 9, 1985

INVENTOR(S) : JUMELLE et al.

It is certified that error appears in the above-identified patent and that said Letters Patent is hereby corrected as shown below:

Col. 9, line 24: "ports" should read --port--.

Col. 9, line 40: "oblique" should read --oblique--.

Col. 12, Line 16: "ringers" should read --fingers--.

Col. 13, line 34: after "plurality" add --of--.

Signed and Sealed this

*Twenty-fifth* Day of *February 1986*

[SEAL]

*Attest:*

DONALD J. QUIGG

*Attesting Officer*

*Commissioner of Patents and Trademarks*